US006771015B2

(12) United States Patent
Lee

(10) Patent No.: US 6,771,015 B2
(45) Date of Patent: Aug. 3, 2004

(54) ELECTRON GUN FOR CATHODE RAY TUBE

(75) Inventor: Soo Keun Lee, Kumi-shi (KR)

(73) Assignee: LG Philips Displays Korea Co., Ltd., Kumi-shi (KR)

( * ) Notice: Subject to any disclaimer, the term of this patent is extended or adjusted under 35 U.S.C. 154(b) by 0 days.

(21) Appl. No.: 10/134,732

(22) Filed: Apr. 30, 2002

(65) Prior Publication Data

US 2003/0168962 A1 Sep. 11, 2003

(30) Foreign Application Priority Data

Mar. 5, 2002 (KR) ..... P2002-11650

(51) Int. Cl.[7] ..... H01J 29/50; H01J 29/46

(52) U.S. Cl. ..... 313/414; 313/417; 313/456; 445/333; 445/34

(58) Field of Search ..... 313/414, 448, 313/458, 451, 482, 457; 445/33, 34, 67

(56) References Cited

U.S. PATENT DOCUMENTS 4,259,610 A * 3/1981 Takanashi et al. ..... 313/417
4,388,552 A 6/1983 Greninger
4,605,880 A * 8/1986 McCandless et al. ..... 313/414
4,607,187 A * 8/1986 Villanyi ..... 313/414
5,202,604 A * 4/1993 Kweon ..... 313/414
5,208,507 A * 5/1993 Jung ..... 313/414
5,429,540 A * 7/1995 Anzai et al. ..... 445/34
5,635,792 A * 6/1997 Jung et al. ..... 313/412

* cited by examiner

*Primary Examiner*—Nimeshkumar D. Patel
*Assistant Examiner*—Anthony Perry
(74) *Attorney, Agent, or Firm*—Birch, Stewart, Kolasch & Birch, LLP

(57) ABSTRACT

Disclosed is an electron gun for a cathode ray tube capable of improving substantial resolution by improving the alignment of a triode portion. The electron gun includes a triode portion composed of at least one cathode for emitting electron beams, and a first electrode and a second electrode for controlling emission amount of the electron beams, a focus electrode and an anode electrode forming a prime lens for focusing the electron beams on a screen, and at least two guide holes housed in more than two electrodes for use of assembly besides electron beam passage holes, in which at least one guide hole is circular and at least one of the other guide holes is non-circular.

8 Claims, 7 Drawing Sheets

ELECTRON GUN FOR CATHODE RAY TUBE

This application claims the benefit of the Korean Application No. P2002-11650 filed on Mar. 5, 2002, which is hereby incorporated by reference.

BACKGROUND OF THE INVENTION

1. Field of the Invention

The present invention relates generally to an electron gun for a cathode ray tube, and more particularly, to an electron gun having guide holes formed for use in alignment of the electron gun for a cathode ray tube.

2. Discussion of the Related Art

As shown in FIG. 1, a conventional color cathode ray tube includes a panel 1 and a funnel 2 made of glass material, a bulb 3 for maintaining 10-7 torr vacuum level, an electron gun 6 housed in a neck portion 4 formed in the bulb 3 for emitting electron beams 5, a shadow mask 8 which makes three electron beams 5 emitted from the electron gun 6 selectively collide with a three-color fluorescent screen 7, such as red (R), green (G), and blue (B), which coats the panel 1, and a deflection yoke 9 disposed in an external portion of the funnel 2 to deflect electron beams 5 emitted from the electron gun 6.

Especially, FIG. 2 depicts a Uni-Bi type electron gun for use in monitors. The electron gun 6 includes a cathode 10 for emitting thermoelectrons, first and second electrodes 11 and 12 for controlling the thermoelectrons emitted from the cathode 10, a third electrode 13 which is configured to an observation direction (Z—Z) to form a prime electrostatic focusing lens for focusing the electron beams 5 on the fluorescent screen 7, a fourth electrode 14, a focus electrode 15, an anode electrode 16, and a shield cup 17 arranged in line, being fastened using a non-insulating bead glass 18.

Although it is not shown in FIG. 2, the amount of the thermoelectrons emitted from the cathode 10 through heat generation of a heater installed at the inside of the cathode 10 is controlled by the cathode 10 and the voltage of the first electrode 11, and is accelerated by the second electrode 12. In general, the voltage amounting to approximately below 1000 volts is applied to the second electrode 12 and the fourth electrode 14, and 20% to 40% of the voltage applied to the anode electrode 16 is applied to the third electrode 13 and the focus electrode 15. In the meantime, an electrostatic lens formed inbetween the second electrode 12 and the third electrode 13, and another electrostatic lens (it is also called a shear focusing lens), which is formed by the third electrode 13, the fourth electrode 14 and the focus lens 15, determines an incident angle, which is the angle of the electron beam 5 incident upon the prime lens. In fact, the prime electrostatic focusing lens (or the prime lens) is formed between the anode electrode 16 and the focus electrode 15, when a high voltage ranging from 20,000 to 35,000 Volts is applied to the anode electrode 16 and about 20% to 40% of the same voltage is applied to the focus electrode 15 that is neighboring to the anode electrode 16 by the space about 1.0 mm.

Therefore, the electron beams formed in a triode portion including the cathode 10, the first electrode 11, and the second electrode 12 forms cross over therein. At first, the electron beams are focused by the shear focusing lens including the third electrode 13, the fourth electrode 14 and the focus electrode 15, and the electron beams are focused by the prime lens including the focus electrode 15 and the anode electrode 16 for the second time, and then forms an image on the screen.

Meanwhile, to actually utilize such electrodes, there needs a process called a beading process for fastening the center of those electrodes and relative positions. In the process, the positions of the electrodes are determined using a beading jig, and the relative position of each electrode is fastened by compressing a bead glass 18 that has been heated at a high temperature over 1000° C. to the electron gun and cooling the heated bead glass.

FIG. 3 illustrates the beading jig 21 generally being used now. Here, mandrills 22*a*, 22*b* and 22*c* are used for determining the position of the three electron beam passage holes. The diameter of the mandrill is approximately 10 to 20 $\mu$m smaller than that of the electron beam passage holes, which is inserted into each electrode in sequence, and a spacer 23 for adjusting the space between the electrodes is used.

As the cathode ray tube gets highly dense, particularly the diameter of the electron beam passage hole of the first electrode 11 is very small like below 0.4 mm, and the thickness of the peripheral electrode of the beam passage hole is very thin like around 0.1 mm. Therefore, once the mandrill is inserted and the beading process is carried out, the electron beam passage holes are severely deformed, often causing defocusing or aberration.

To overcome the problems described above, what people tried was installing separate guide holes 30*a* and 30*b* to determine the positions as shown in FIG. 4, and added guide pins 34*a* and 34*b* to the beading jig 31 as depicted in FIG. 5 to make the beading process possible using the guide holes. In addition, the mandrills 32*a*, 32*b* and 32*c* do not have their own pins because they should not be in touch with the electron beam passage holes of the first electrode 35 and the second electrode 36. It is so because if the mandrills 32*a*, 32*b* and 32*c* do not pass through the electron beam passage holes of the first electrode 35 and the second electrode 36, the beam passage holes 35*a*, 35*b* and 35*c* of the first electrode 35 would not be damaged by the force generated from the compression of the bead glass during the beading process, so the defocusing problem due to the electrode deformation can be successfully prevented.

However, now that each electron beam passage hole associated with the first electrode 35, the second electrode 36 and the third electrode 37 is not necessarily set up on the basis of an individual electron beam passage hole, but the position determining holes, or the guide holes 30*a* and 30*b*, set up the passage holes, and the positions of each electron beam passage holes that influence the actual electron beam's focus are largely determined by the relative positions of the center of the guide holes and the electron beam passage holes, it is always possible to have the defocusing problem due to a discrepancy between the centers of the beam passage holes by one-sided halo.

With reference to FIG. 6, the followings explain how to calculate the aberration of the electron beam passage holes of the triode electrode in accordance with the relation between the guide holes 30*a* and 30*b* of the triode electrode and the guide pins 34*a* and 34*b* of the beading jig 31.

Typically, the size of the guide holes 30*a* and 30*b* has ±5 $\mu$m of precision, and the distance between two guide holes, being a relatively large value, has ±10 $\mu$m of precision. Suppose that the size of the guide holes is 1.000±0.005 mm, and the distance between the two guide holes is 20.0±0.010 mm. Then, the size of the guide pins 34*a* and 34*b* of the beading jig 31 for production is determined as follows. First of all, the minimum size of the guide holes 30*a* and 30*b*, 0.995 mm, is subtracted by twice of the deflection distance aberration between the two guide holes, 0.020 mm (2×0.010 mm), to yield 0.975 mm. Then, 0.975 mm is again subtracted by twice of the margin for the guide holes 30*a* and 30*b*, and the guide pins 34*a* and 34*b* for securing assembly, 0.010 mm (2×0.005 mm), to yield 0.965 mm. Of course, it is always possible that the guide pins 34*a* and 34*b* have manufacturing error, but since it is relatively very small, the error can be disregarded. This means that the final size of the guide pins 34*a* and 34*b* is 0.965 mm, and a possible maximum position error according to the sizes of the guide holes and the guide pins is (1.005−0.965)/2, or 0.020 mm.

Because the first electrode 35, the second electrode 36, and the third electrode 37 are separate components from one another, the positions of the guide holes 30*a* and 30*b* of each electrode and the positions of the guide pins 34*a* and 34*b* of the beading jig 31 are mainly dependent on probability. In other words, if the guide holes are not in precise positions, each electron beam passage hole that is perforated according to the positions of the guide holes cannot be placed in a precise position either.

Although the position error of the electron beam passage hole of each electrode is 0.020 mm, disregarding the position error of the guide holes and the electron beam passage holes, if two neighboring electrodes deflect from the center by 0.020 mm to the opposite directions, the maximum position error from the centers of the two electron beam passage holes will be 0.040 mm.

FIG. 7 is a view of the beam configuration and its size on the screen according to the eccentricity among the triode electrodes, which is seen through a computer analysis. As depicted in FIG. 7*b*, if each electrode deflects from the center by 0.020 mm to the opposite directions, a serious defocusing problem due to the one-sided halo.

According to the analytic result of an ideal case where no eccentricity of the triode portion exists as shown in FIG. 7*a*, the beam diameter on the screen is 0.49×0.50 mm. On the other hand, if the first electrode and the second electrode happen to have 0.02 mm of oppositely directed eccentricity towards the horizontal direction, the beam diameter in FIG. 7*b* is 0.67×0.52 mm. As noted here, the one-sided halo and the beam diameter on the screen increase along with the direction where the eccentricity exists. In reality though, direction of the eccentricity in accordance with the discrepancy between the size of guide holes and its corresponding size of guide pins is pretty hard to predict. In some cases, the one-sided halo occurs towards one direction, either horizontally or vertically, and in other cases, to the combination direction thereof. As manifested in FIG. 7*c*, as the position of electron beam shifts, other characteristics of relevant cathode ray tube get negative influences thereof. Therefore, to improve actual focus performance and general characteristics of a cathode ray tube, a special design that is capable of minimizing the eccentricity of triode electrodes should be developed.

SUMMARY OF THE INVENTION

Accordingly, the present invention is directed to an electron gun for a cathode ray tube that substantially obviates one or more problems due to limitations and disadvantages of the related art.

An object of the present invention is to provide an electron gun for a cathode ray tube capable of increasing substantial resolution by improving the alignment of a triode portion.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an electron gun for a cathode ray tube includes a triode portion composed of at least one cathode for emitting electron beams, and a first electrode and a second electrode for controlling emission amount of the electron beams; a focus electrode and an anode electrode forming a prime lens for focusing the electron beams on a screen; and at least two guide holes housed in more than two electrodes for use of assembly besides electron beam passage holes, in which at least one guide hole is circular and at least one of the other guide holes is non-circular.

Preferably, the non-circular guide hole has a horizontal straight line portion or a horizontal diameter and a vertical diameter are different from each other.

In addition, the linear portion is preferably longer than 0.02 mm, and the difference between the horizontal diameter and the vertical diameter is preferably greater than 0.02 mm.

In the meantime, the electrode formed of the guide holes includes the first electrode and the second electrode, and the number of the guide holes included is two.

Therefore, the electron gun of the present invention is very useful for improving the configuration of the guide hole, which consequently decreases the eccentricity of the triode portion.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 8:
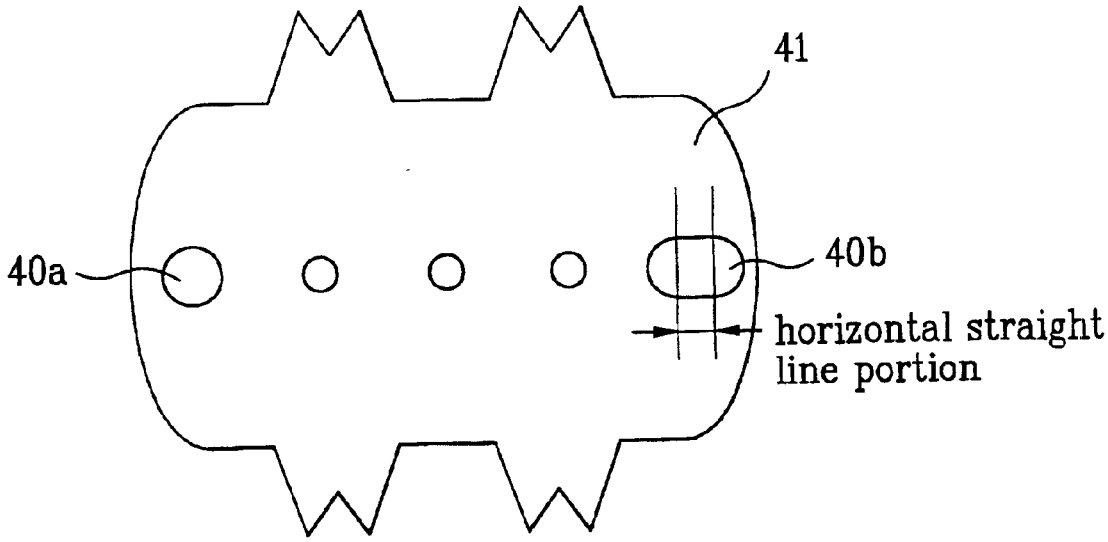
FIG. 8 is a plan view of a first electrode of an electron gun for a cathode ray tube in accordance with the present invention.

FIG. 8 illustrates a first electrode 41 according to a preferred embodiment of the present invention. Since one of two guide holes 40*a* and 40*b* is shaped along with the extended line direction, there is no interference from the guide hole 40*b* and the guide pin 34*b*.

Figure 9:
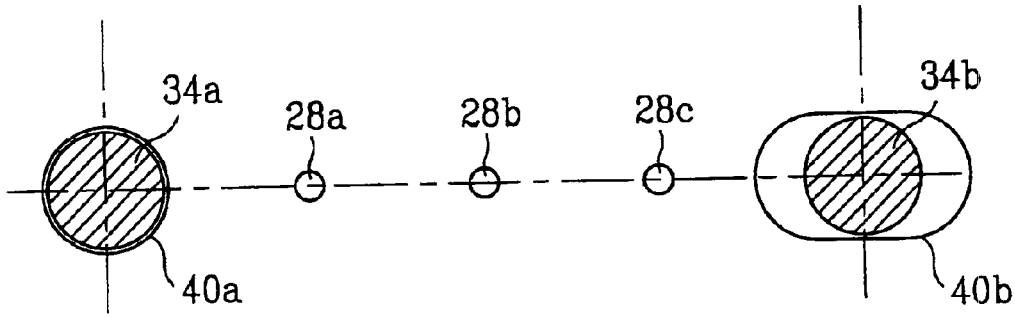
FIG. 9 is a diagram illustrating the relation between guide holes and guide pins of the electron gun for a cathode ray tube in accordance with the present invention.

FIG. 9 illustrates the relation between the guide holes 40*a* and 40*b* and the guide pins 34*a* and 34*b* according to the present invention.

As depicted in the drawing, the left side guide hole 40*a* is designed to have a circular shape, and the right side guide hole 40*b* is formed longitudinally to the extended line direction of the two guide holes. Therefore, the left side guide hole 40*a* together with the left side guide pin 34*a* determine the position of the first electrode in all directions, and similarly, the rectangular guide hole 40*b* on the right side together with the right side guide pin 34*a* determine the position of the first electrode in a vertical direction.

Having the left side guide hole 40*a* and the left side guide pin 34*a* form a pivot, and having the right side guide hole 40*b* and the right side guide pin 34*b* control the rotation round the pivot formed by the left side guide hole 40*a* and the left side guide pin 34*a*, the positions of entire electrodes could be determined. At this time, even through a circular-shaped guide pin may have been used, since there is no restraint on the movement of the right side guide pin and the right side guide hole to the right and left direction, they can move freely to the right and left direction. In short, no matter how slightly different the positions of the guide hole and the guide pin may be in the right and left direction, the insertion thereof can be done regardless of the difference. It is so because, according to the present invention, the insertability of the guide pin is pretty much related to the difference between the diameter of the guide hole and that of the guide pin. That is to say, when designing the diameter of a guide pin, the distance gap between the guide pin and the guide hole does not need to be considered.

If the same tolerance with the prior art is applied to the electrode according to the present invention, the size of the beading jig for production is determined as follows. First of all, the minimum size of the guide hole, 0.995 mm, is subtracted by twice of a margin for the guide hole and the guide pin to each direction, 0.01 mm (2×0.005 mm), to yield 0.985 mm. As mentioned before, the distance tolerance between guide holes can be neglected.

Therefore, according to the present invention, a possible maximum position error by the sizes of guide holes and guide pins is (1.005−0.985)/2, or 0.01 mm, which is only half of the maximum position error of guide holes and guide pins obtained in the prior art. In other words, the relative position error of the electron beam passage holes of two neighboring electrodes is ±0.010 mm, which is as much as 0.020 mm smaller than that of the prior art, ±0.020 mm.

Given that the position error between two guide holes, a typical component manufacturing capacity, ±0.010 mm, is taken into consideration, the difference between the horizontal diameter and the vertical diameter of a non-circular guide hole should not exceed 0.02 mm in order to get rid of any interference by the position error between the guide pin and the guide hole. In short, the horizontally directed line portion at the center of the non-circular guide hole is preferably greater than 0.02 mm.

Figure 1:
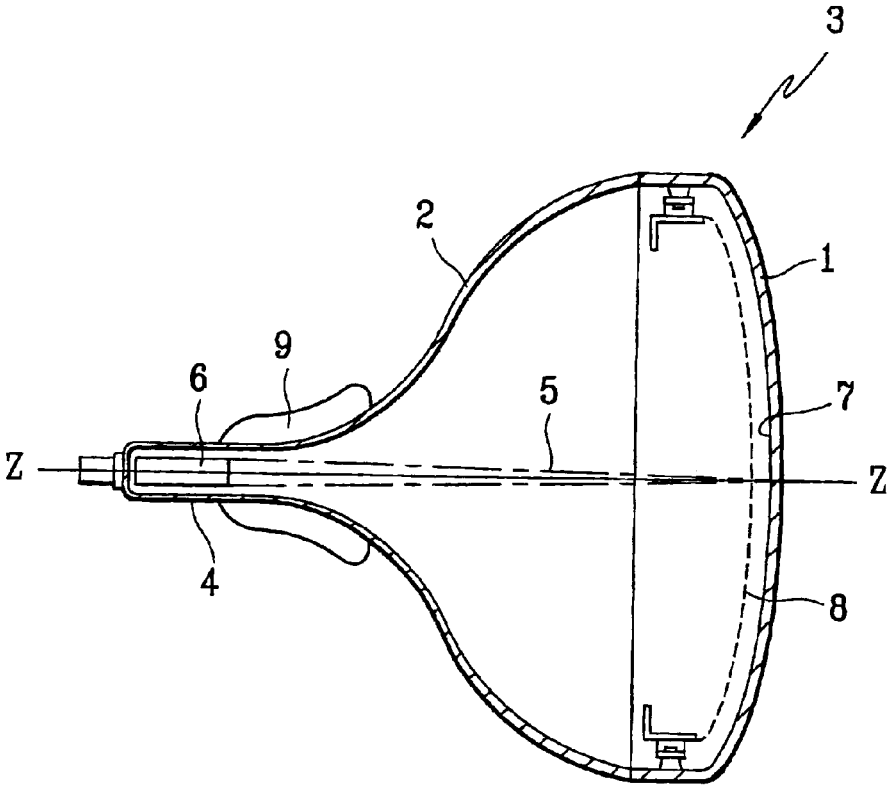
FIG. 1 Related Art
FIG. 1 is a schematic sectional view of a general cathode ray tube.
Figure 2:
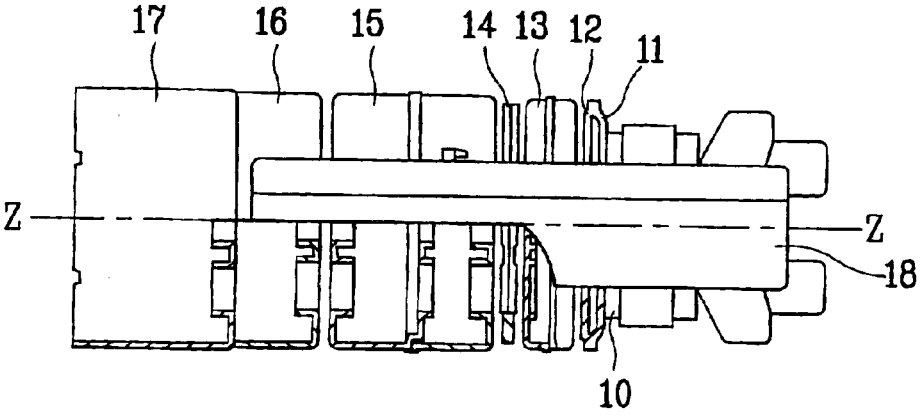
FIG. 2 Related Art
FIG. 2 is a partial cutaway, sectional view of a conventional electron gun for a cathode ray tube.
Figure 3:
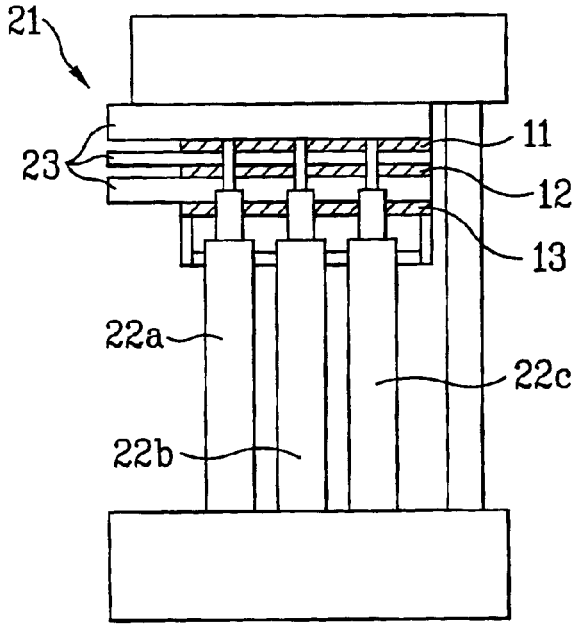
FIG. 3 Related Art
FIG. 3 is an assembly diagram of a beading jig and an electrode in accordance with a conventional technique.
Figure 4:
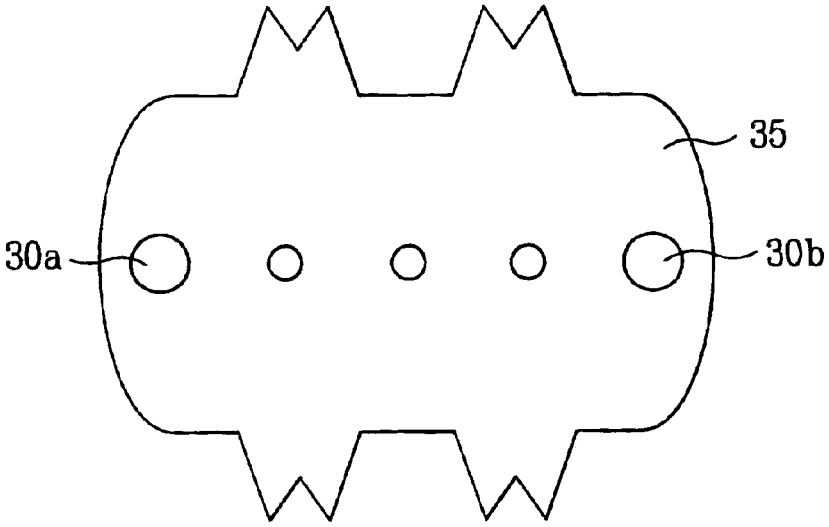
FIG. 4 Related Art
FIG. 4 is a plan view of a first electrode in accordance with a conventional technique.
Figure 5:
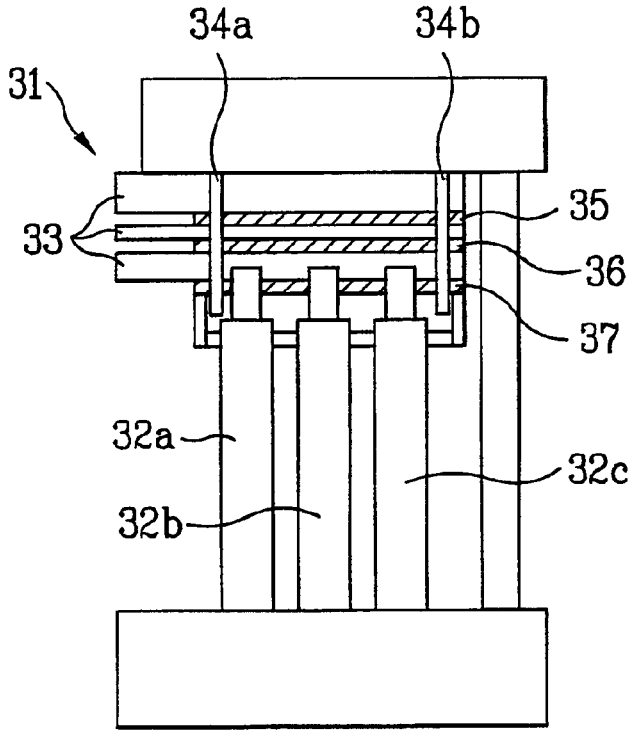
FIG. 5 Related Art
FIG. 5 is an assembly diagram of a beading jig and an electrode in accordance with another conventional technique, being different from the FIG. 3.
Figure 6:
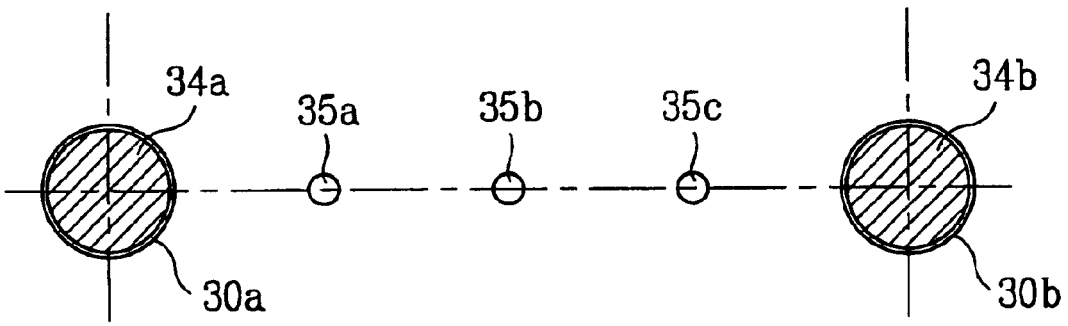
FIG. 6 Related Art
FIG. 6 diagrammatically illustrates the relation between a guide hole and a guide pin in accordance with a conventional technique.
Figure 7A:
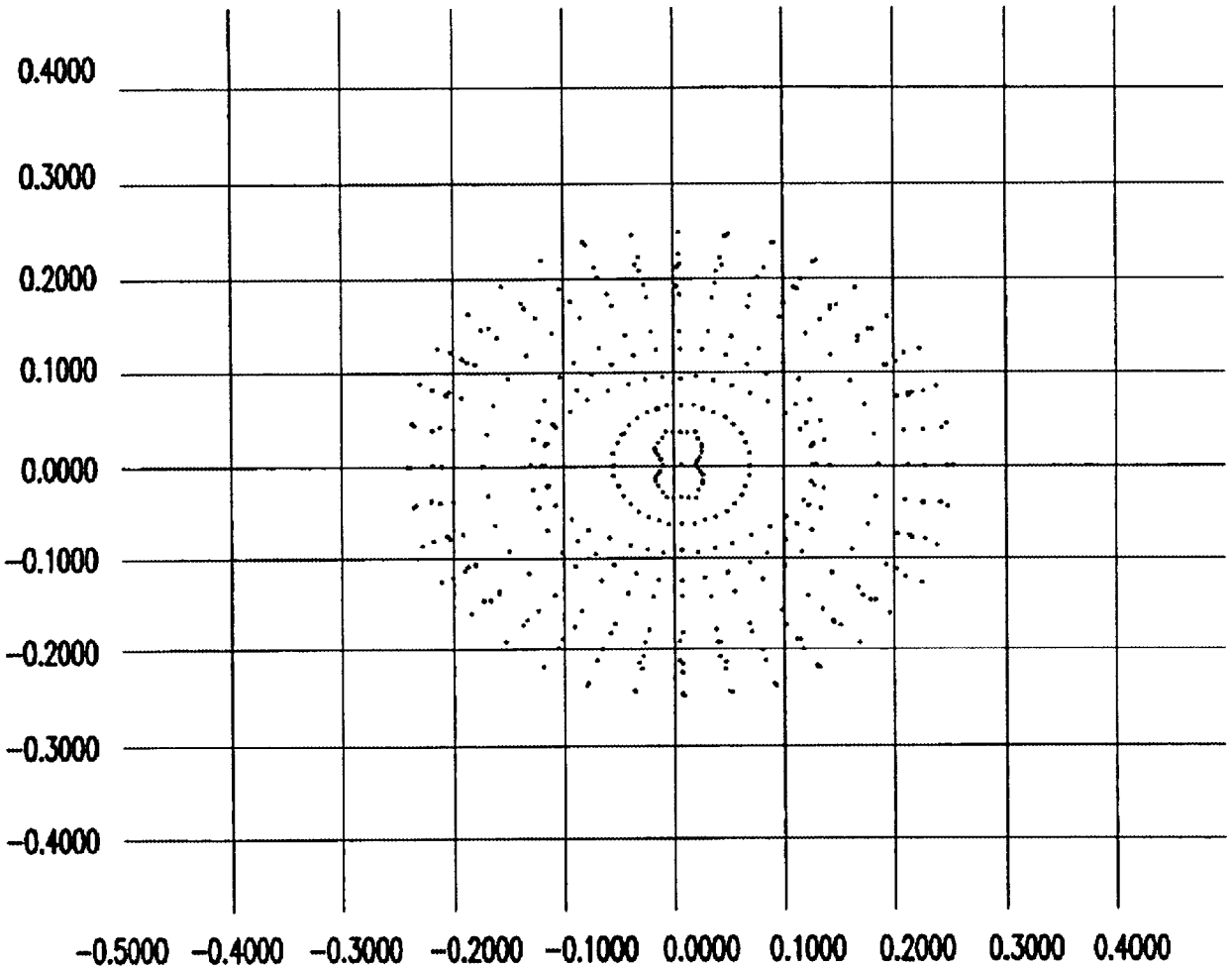
FIGS. 7*a*, 7*b*, and 7*c* are graphs illustrating a computer analytic result regarding the shape and size of electron beams according to the eccentricity of each triode portion electrode.
Figure 7B:
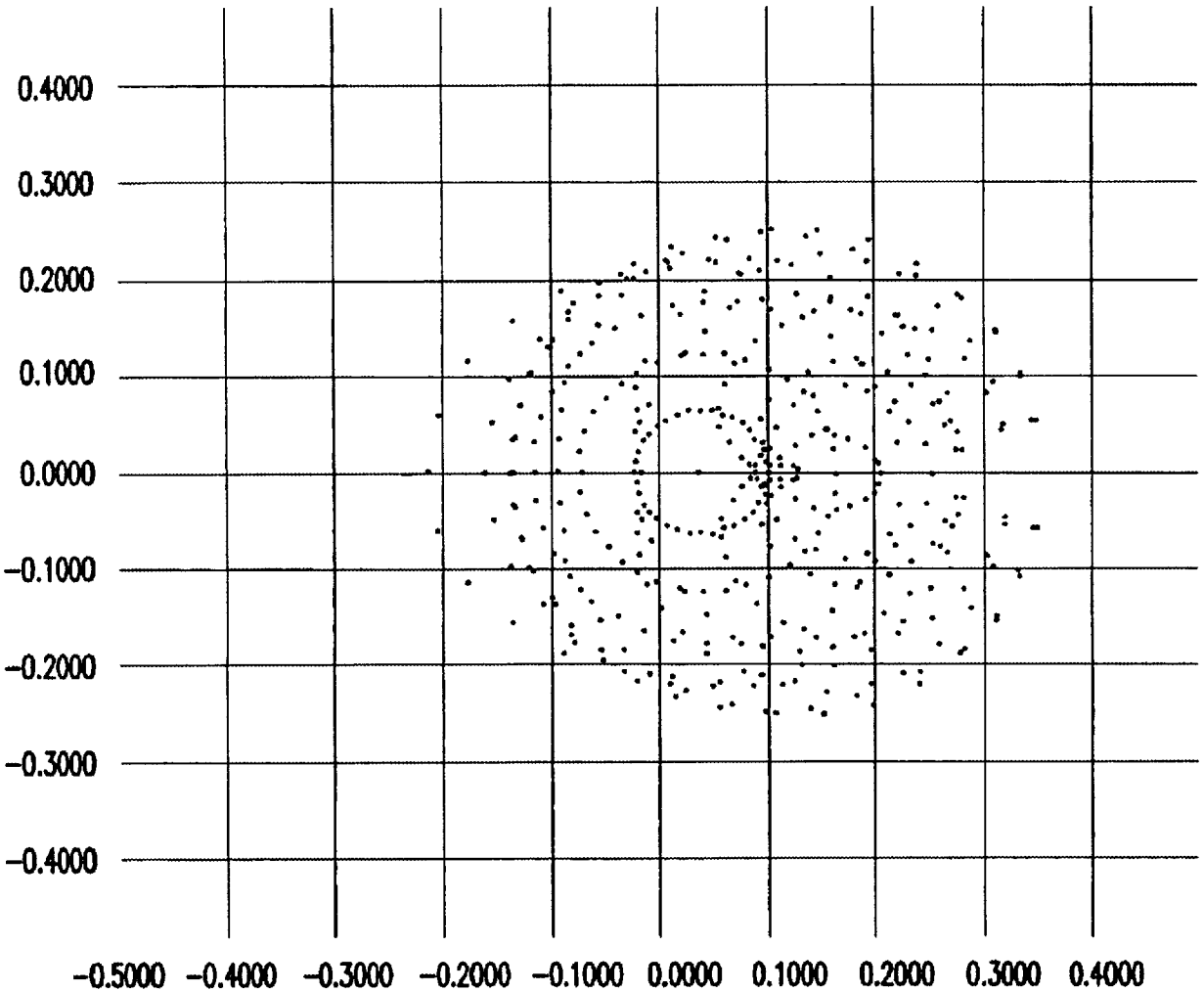
Figure 7C:
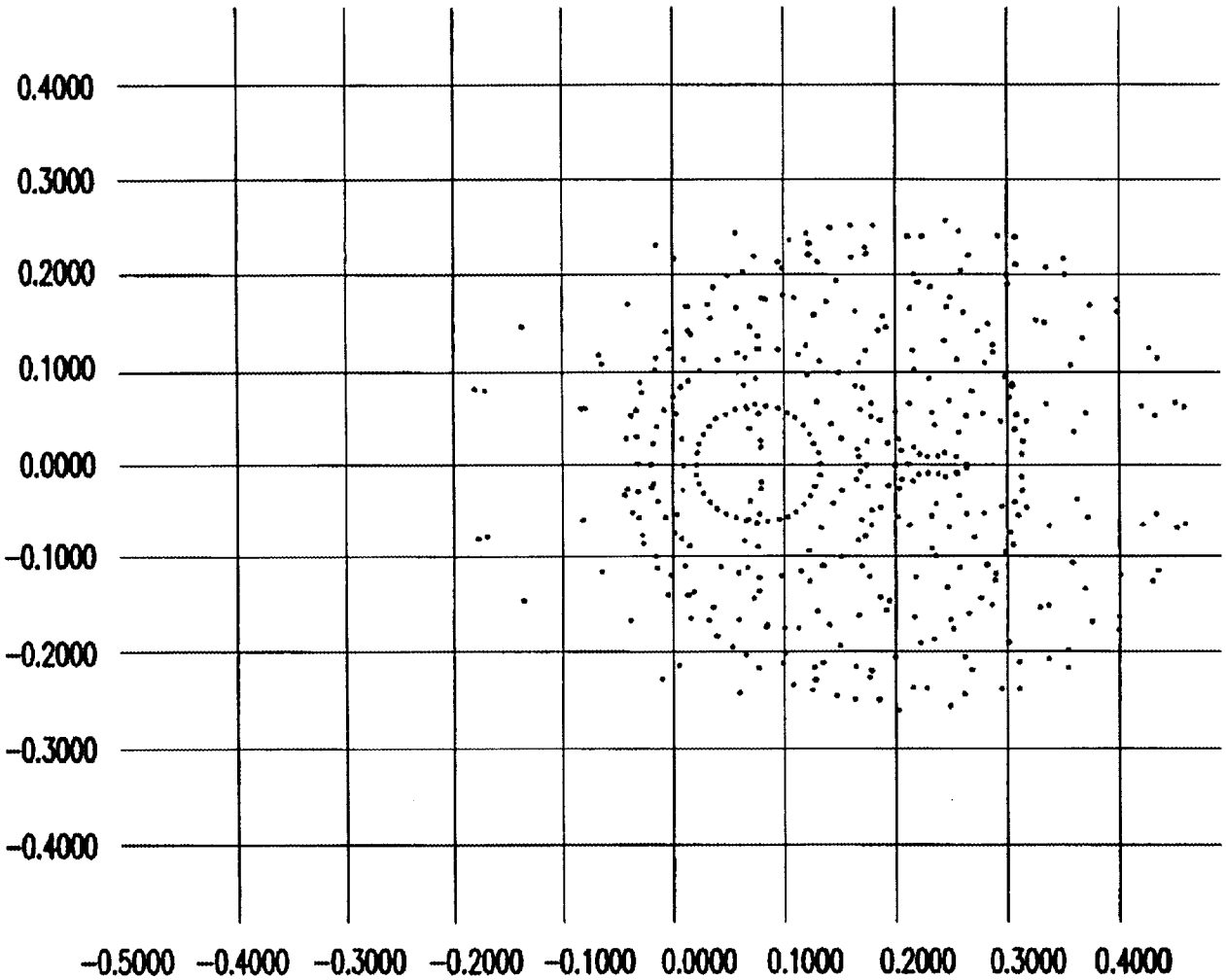

As noted in the result of FIG. 7*c*, in case that the first electrode and the second electrode have an oppositely directed eccentricity by 0.01 mm to the horizontal direction, respectively, the beam diameter on the screen is 0.57×0.51 mm, which is smaller than that of the prior art, 0.67×0.52 mm, as shown in FIG. 7*b*, in which the first electrode and the second electrode have an oppositely directed eccentricity by 0.02 mm to the horizontal direction, respectively. This means that the present invention has a comparatively smaller beam diameter and few one-sided halo phenomena. Therefore, as confirmed through the computer analysis, when the electron gun triode portion electrode according to the present invention is used, the focus quality is substantially improved.

In addition, as the position of rectangular guide hole 40*b* of the present invention becomes insignificant at least to the extension line direction of two guide holes, it is now possible to set the position error from the manufacture to be greater than ±0.1 mm, thereby improving the manufacturability and productivity of components in general.

In conclusion, the present invention enables to minimize the eccentricity of facing electron beam passage space of two neighboring electrodes without deforming the electron beam passage holes of the first electrode and the second electrode, which consequently decreases the one-sided halo amount due to the eccentricity and improves the actual focus performance of an electron gun. Moreover, general characteristics of a cathode ray tube are improved by keeping the paths of electron beams uniform. Shortly speaking, the present invention makes possible to realize an electron gun with stabilized focus performance and improved properties for the cathode ray tube.

It will be apparent to those skilled in the art than various modifications and variations can be made in the present invention. Thus, it is intended that the present invention covers the modifications and variations of this invention provided they come within the scope of the appended claims and their equivalents.

What is claimed is:

1. An electron gun for a cathode ray tube, the electron comprising:

a triode portion composed of at least one cathode for emitting electron beams, and a first electrode and a second electrode for controlling emission amount of the electron beams;

a focus electrode and an anode electrode forming a prime lens for focusing the electron beams on a screen; and at least two guide holes separate from electron beam passage holes housed in more than two electrodes for aligning electrodes during assembly, in which at least one guide hole is circular and at least one of the other guide holes in non-circular.

2. The electron gun according to claim 1, wherein the non-circular guide hole has a horizontal straight line portion.

3. The electron gun according to claim 1, wherein the non-circular guide hole has a horizontal diameter and a vertical diameter that are different from each other.

4. The electron gun according to claim 2, wherein the straight line portion is longer than 0.02 mm.

5. The electron gun according to claim 3, wherein the difference between the horizontal diameter and the vertical diameter is greater than 0.02 mm.

6. The electron gun according to one of claims 1 through 3, wherein the electrodes having the guide holes include a first electrode and a second electrode.

7. The electron gun according to one of claims 1 through 3, wherein two guide holes are formed on the electrode.

8. The electron gun according to claim 1, wherein one of the diameters of the non-circular guide hole is the same as the diameter of the circular guide hole.

* * * * *